US010001755B2

(12) United States Patent
Heinz

(10) Patent No.: US 10,001,755 B2
(45) Date of Patent: Jun. 19, 2018

(54) CHRONOGRAPH

(71) Applicant: Uwe Heinz, Manching (DE)

(72) Inventor: Uwe Heinz, Manching (DE)

( * ) Notice: Subject to any disclaimer, the term of this patent is extended or adjusted under 35 U.S.C. 154(b) by 169 days.

(21) Appl. No.: 14/862,602

(22) Filed: Sep. 23, 2015

(65) Prior Publication Data

US 2016/0011568 A1 Jan. 14, 2016

Related U.S. Application Data

(63) Continuation of application No. PCT/IB2014/060166, filed on Mar. 26, 2014.

(30) Foreign Application Priority Data

Mar. 28, 2013 (DE) ..... 10 2013 103 180

(51) Int. Cl.
*G04F 7/08* (2006.01)

(52) U.S. Cl.
CPC ..... *G04F 7/0814* (2013.01)

(58) Field of Classification Search
CPC ..... G04F 7/08; G04F 7/0814
See application file for complete search history.

(56) References Cited

U.S. PATENT DOCUMENTS

RE10,770 E 9/1886 Lugrin
2,551,100 A 5/1951 Davis
3,903,686 A 9/1975 Burki
2008/0310257 A1* 12/2008 Perret ..... G04F 7/0847 368/106
2008/0310258 A1* 12/2008 Trifoni ..... G04B 3/048 368/106

FOREIGN PATENT DOCUMENTS

CH 661404 A 7/1987
CH 698827 11/2009
CN 1430738 7/2003
(Continued)

OTHER PUBLICATIONS

ISR for PCT/IB2014/060166.
Office Action for DE 10 2013 103 180.3 dated Oct. 29, 2013.

*Primary Examiner* — Edwin A. Leon
*Assistant Examiner* — Jason Collins
(74) *Attorney, Agent, or Firm* — Simpson & Simpson, PLLC

(57) ABSTRACT

A chronograph having a second wheel with an entraining spring, a pulse-receiving wheel, wherein the entraining spring is constructed to engage with the pulse-receiving wheel, a pulse-transferring wheel, a minute wheel, wherein the minute wheel is in constant engagement with the pulse-transferring wheel, a second shaft, wherein the second wheel is rigidly connected to the second shaft, a multifunction shaft is orientated parallel to the second shaft, wherein the pulse-receiving wheel and the pulse-transferring wheel is rigidly connected to the multifunction shaft, and, a two-part constructed zeroing lever having a zeroing lever arm and a zeroing lever interlock, wherein the zeroing lever arm is supported in a rotatable manner around a pivotal point of a zeroing lever arm and the zeroing lever interlock is supported in a rotatable manner around a pivotal point of zeroing lever interlock.

10 Claims, 3 Drawing Sheets

(56) References Cited

FOREIGN PATENT DOCUMENTS

| | | | |
|---|---|---|---|
| CN | 1497400 | | 5/2004 |
| CN | 101126915 | | 2/2008 |
| CN | 101833279 | | 9/2010 |
| DE | 69830930 | T2 | 3/2006 |
| EP | 1046970 | B1 | 7/2005 |

* cited by examiner

Prior Art

CHRONOGRAPH

CROSS-REFERENCE TO RELATED APPLICATIONS

This application is filed under 35 U.S.C. § 111(a) and § 365(c) as a continuation of International Patent Application No. PCT/IB2014/060166, filed Mar. 26, 2014, which application claims priority from German Patent Application No. DE 10 2013 103 180.3, filed Mar. 28, 2013, which applications are incorporated herein by reference in their entireties.

FIELD OF THE INVENTION

The present invention relates generally to a chronograph.

BACKGROUND OF THE INVENTION

A mechanic clockwork has as central components a mainspring barrel, a gear train, an escapement and an oscillator (balance wheel). Thereby the barrel with the mainspring provides the drive of the clockwork. Transferring the force occurs beginning at the mainspring barrel, via the movement to the escape wheel, which constitutes a component of the escapement. The movement drives the hands of the clock and transmits the spring force, which is stored in the mainspring, into rotations with different velocities, by what seconds, minutes, hours and so on are indicated.

U.S. Pat. No. 3,903,686 reveals a chronograph with a second hand, a minute hand and an hour hand, wherein these hands are combined with a minute- and second counter and possess the characteristic, that the second hand, the minute counter and the hour counter can be positioned to zero.

The German translation DE 698 30 930 T2 of the European patent EP 1 046 970 B1 reveals an intermittent feeding mechanism, by which a feeding latch is mounted on a first counting wheel with a part of a spring. The feeding latch rotates together with a first counting wheel, so that each turnaround of the feeding latch catches a gear of a second counting wheel or a second intermediate counting wheel, whereby the second counting wheel or the second intermediate counting wheel is pushed forward in an intermittent manner. This intermittent feeding mechanism has a protruding part mounted on the feeding latch, whereby a positioning hole is provided in a component of the first counting wheel. When the protruding part is inserted into the positioning hole and the protruding part is drifted through a part of the spring of the feeding latch, a positioning of the feeding latch occurs.

The escapement wheel represents the connection between the gear train and balance wheel of the clockwork. The balance wheel comprises an oscillating body, which is mounted in a rotatable manner around an axis of rotation by means of a balance wheel shaft. In addition a spiral spring is provided, which forms the oscillatory and clocking system together with the mass of the oscillating body. Finally the balance wheel comprises a device for regulating gears as for example a jiggler, with which the characteristics of the oscillation of the spiral spring can be changed and therefore the desired correct rate of the watch can be set. The proper rate of the watch is based on a preferably steady bidirectional oscillation of the balance wheel. Without delivering energy permanently, the balance wheel would however stop its movement. That is why the force, coming from the mainspring barrel, is transmitted continuously via the gear train to the balance wheel. The escapement transfers the force via escapement wheel and tie bar to the balance wheel. Thereby the tie bar engages alternately in a retardant and released manner into the escaping wheel that the movement always pulses in the same tempo.

Thereby, depending on the oscillation frequency of the balance wheel, an exact basic time unit is determined, on which the remaining arithmetic of the transferring wheels and therefore the accuracy of the clock is based. The exactness of the measurements of a mechanic chronograph also depends completely directly on this unit, since the chronograph is usually driven by the movement of the clock.

A chronograph, as for example the clockwork of type ETA Valjoux 7750, has at least a second hand and a minute hand, which can be stopped, reset to zero and started again on demand. The display of the measured time interval by means of a chronograph, can occur thereby by separate second- and minute dials or by a second hand and a minute hand, disposed coaxially with the original hands of the clock. In case of coaxially disposed hands, it is called a center second hand and a center minute hand.

The drive of the chronograph, which is shown in FIG. 1 and known from the prior art, occurs via a swiveling drive (not shown), which forces the gear train of the clock to engage with the second wheel 3. The pulse-receiving wheel 6 and the drive wheel 7, which is coaxially disposed above and rigidly connected to the pulse-receiving wheel 6, are suspended and are rigidly connected to a shaft (not shown), which is in turn is rotatable mounted in a plate disposed above the drive wheel 7.

The entraining spring 5 is rigidly connected to the second wheel 3 with its section averted from the pulse-receiving wheel 6. The section of the entraining spring 5, which is turned towards the pulse-receiving wheel 6, is developed resilient and provided for engagement into the pulse-receiving wheel 6.

The zeroing shaft 11 is rigidly connected to the zeroing wheel 8. The zeroing shaft 11 bears at its end, averted to the zeroing wheel 8, the intermediate wheel 15, which is in constant engagement with the pulse-transmitting wheel 9, which is in turn in constant engagement with the minute wheel 10. After a complete rotation of the second wheel 3, so after 60 seconds, the pulse-receiving wheel 6 is rotated for 6° by the entraining spring 5. The zeroing wheel 8, the intermediate wheel 15, the pulse-transmitting wheel 9 and the minute wheel 10 are moved further by means of the drive wheel 7, by what the center minute hand 2, which is rigidly connected to the minute wheel 10, finally advances for one unit.

The center second hand 1 is rigidly connected to the second shaft 4, which is in turn rigidly connected to the second wheel 3. The second shaft 4 penetrates the center of the minute wheel 10. The slewing drive (not shown) provides a direct drive of the second hand 3, whereby the center second hand 1 is moved via the second shaft 4.

A further component of the chronograph is the two-part developed zeroing lever 12, comprising a zeroing lever arm 12*a* and a zeroing interlock 12*b* (not visible in FIG. 1), wherein the zeroing lever 12 is stored in a rotatable manner around the pivotal point of the zeroing lever arm 19. The zeroing lever interlock 12*b* (see FIG. 3) is in turn connected in a rotatable manner around the pivotal point of the zeroing lever interlock to the zeroing lever arm 12*a*. The zeroing lever arm 12*b* is located in one plane with the zeroing heart for minutes 17 and the zeroing heart for seconds 16. The zeroing heart for minutes 17 is rigidly connected to the zeroing wheel 8 via the zeroing shaft 11, whereas the zeroing heart for seconds 16 is rigidly connected to the second wheel 3 via the second shaft 4.

For stopping the chronograph, the slewing drive (not shown) is forced to release its engagement with the second wheel 3 with the help of a pusher (not shown). In addition, operating the pusher occurs in forcing an appropriate holding means (not shown), as for example a blocking interlock, to engage with the second wheel 3. Operating the pusher therefore results in a halt of center second hand 1 and center minute hand 2.

For bringing the chronograph into its zero position for a further measurement of time, the blocking interlock (not shown) is forced to release its engagement with the second wheel 3 by means of a further pusher. Simultaneously, by operating the pusher, the zeroing lever arm 12*a* and therefore the zeroing lever interlock 12*b*, as well, are pivoted for a small value in their corresponding plane, whereby the zeroing lever interlock 12*b* contacts with its front the zeroing heart for minutes 17 as well as the zeroing heart for seconds 16. Therefore the zeroing heart for minutes 17 and the zeroing wheel 8, which is rigidly connected to the zeroing heart 17 via the zeroing shaft 11, as well as the zeroing heart for seconds 16 and the second wheel 3, which is rigidly connected to the zeroing heart 16 via the second shaft 4, are rotated so far until they are located in their zero position. This is the case, if the first angled end 13 of the zeroing lever interlock 12*b* touches the flattened end 17' of the zeroing heart for minutes 17 and the second angled end 14 of the zero lever interlock 12*b* touches the flattened end 16' of the zeroing heart for seconds 16.

Due to the movement of the zeroing wheel 8 in its zero position, the intermediate wheel 15, the pulse-transmitting wheel 9, the minute wheel 10 and the center minute hand 2 are moved to their particular zero position, as well. Analogous to that due to the movement of the second wheel 3 to its zero position, the center second hand 1 is moved to its zero position, as well.

BRIEF SUMMARY OF THE INVENTION

The present invention comprises a chronograph having a second wheel having an entraining spring, a pulse-receiving wheel, wherein the entraining spring is configured to engage with the pulse-receiving wheel, a pulse-transferring wheel, a minute wheel, wherein the minute wheel is in constant engagement with the pulse-transferring wheel, a second shaft, wherein the second wheel is rigidly connected to the second shaft, and, a multifunction shaft orientated parallel to the second shaft, wherein the pulse-receiving wheel and the pulse-transferring wheel is rigidly connected to the multifunction shaft.

The present invention also comprises a chronograph having a second wheel with an entraining spring, a pulse-receiving wheel, wherein the entraining spring is constructed to engage with the pulse-receiving wheel, a pulse-transferring wheel, a minute wheel, wherein the minute wheel is in constant engagement with the pulse-transferring wheel, a second shaft, wherein the second wheel is rigidly connected to the second shaft, a multifunction shaft is orientated parallel to the second shaft, wherein the pulse-receiving wheel and the pulse-transferring wheel is rigidly connected to the multifunction shaft, and, a two-part constructed zeroing lever having a zeroing lever arm and a zeroing lever interlock, wherein the zeroing lever arm is supported in a rotatable manner around a pivotal point of a zeroing lever arm and the zeroing lever interlock is supported in a rotatable manner around a pivotal point of zeroing lever interlock.

A general object of the present invention is to provide a chronograph with a preferably frictionless drive of the center second hand and center minute hand. Additionally an optimal force transmission should be achieved in the field of mechanic chronographs.

Another object of the present invention is to provide a chronograph with a preferably frictionless drive of the center second hand and center minute hand. Additionally, a zeroing of the center second hand and center minute hand is eased in the field of mechanic chronographs.

The inventive chronograph has a center second hand and a center minute hand. The chronograph has a second wheel with an entraining spring and a pulse-receiving wheel, wherein the entraining spring is constructed to engage with the pulse-receiving wheel. In addition a drive wheel and a zeroing wheel are provided, wherein the zeroing wheel is in constant engagement with the drive wheel. Furthermore a drive wheel and a zeroing wheel are provided, wherein the zeroing wheel is in constant engagement with the drive wheel. The chronograph further comprises a pulse-transmitting wheel and a minute wheel, wherein the minute wheel is in constant engagement with the pulse-transmitting wheel and the center minute hand is rigidly connected to the minute wheel. Finally a second shaft is provided, wherein the second wheel and the center second hand are rigidly connected to the second shaft. The chronograph, according to the invention, has a multifunction shaft, which is parallel orientated to the second shaft, wherein the pulse-receiving wheel, the drive wheel and the pulse-transmitting wheel are connected coaxially rigidly to the multifunction shaft.

Due to the inventive use of a multifunction shaft, which is parallel orientated to the second shaft, a drive of the center minute hand is achieved, wherein the drive is associated with reduced friction, compared to the solutions, known from the prior art. In contrast to the four transmissions for transferring the pulse of the entraining spring to the minute wheel, so from the entraining spring to the pulse-receiving wheel, from the drive wheel to the zeroing wheel, from the intermediate wheel to the pulse-transmitting wheel and from the pulse-transmitting wheel to the minute wheel, the solution, according to the invention only requires two transmission, so from the entraining spring to the pulse-receiving wheel and from the pulse-transmitting wheel to the minute wheel. A short, direct way from the entraining spring of the second wheel to the minute wheel is achieved by the multifunction shaft. A reduced frictional loss and an optimal pulse transmission is associated with the reduced number of transmission for transmitting the pulse. This finally results in an increased accuracy of the chronograph.

Additionally, the chronograph has a two-parts designed zeroing lever, which comprises a zeroing lever arm and a zeroing lever interlock, wherein the zeroing lever interlock has a first angled end and a second angled end. Besides, according to this embodiment, a zeroing heart for minutes and a zeroing heart for seconds are provided, wherein the zeroing heart for minutes has a flattened end and the zeroing heart for seconds has a flattened end. In zero position of the chronograph, the first angled end of the zeroing lever head is in contact with the flattened end of the zeroing heart for minutes and the second angled end of the zeroing lever head is in contact with the flattened end of the zeroing heart for seconds. An exact zero position of the chronograph is reached by these additional provided elements before executing a time measurement.

These and other objects, advantages and features of the present invention will be better appreciated by those having ordinary skill in the art in view of the following detailed description of the invention in view of the drawings.

BRIEF DESCRIPTION OF THE DRAWINGS

The nature and mode of operation of the present invention will now be more fully described in the following detailed description of the invention taken with the accompanying figures, in which.

DETAILED DESCRIPTION OF THE INVENTION

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
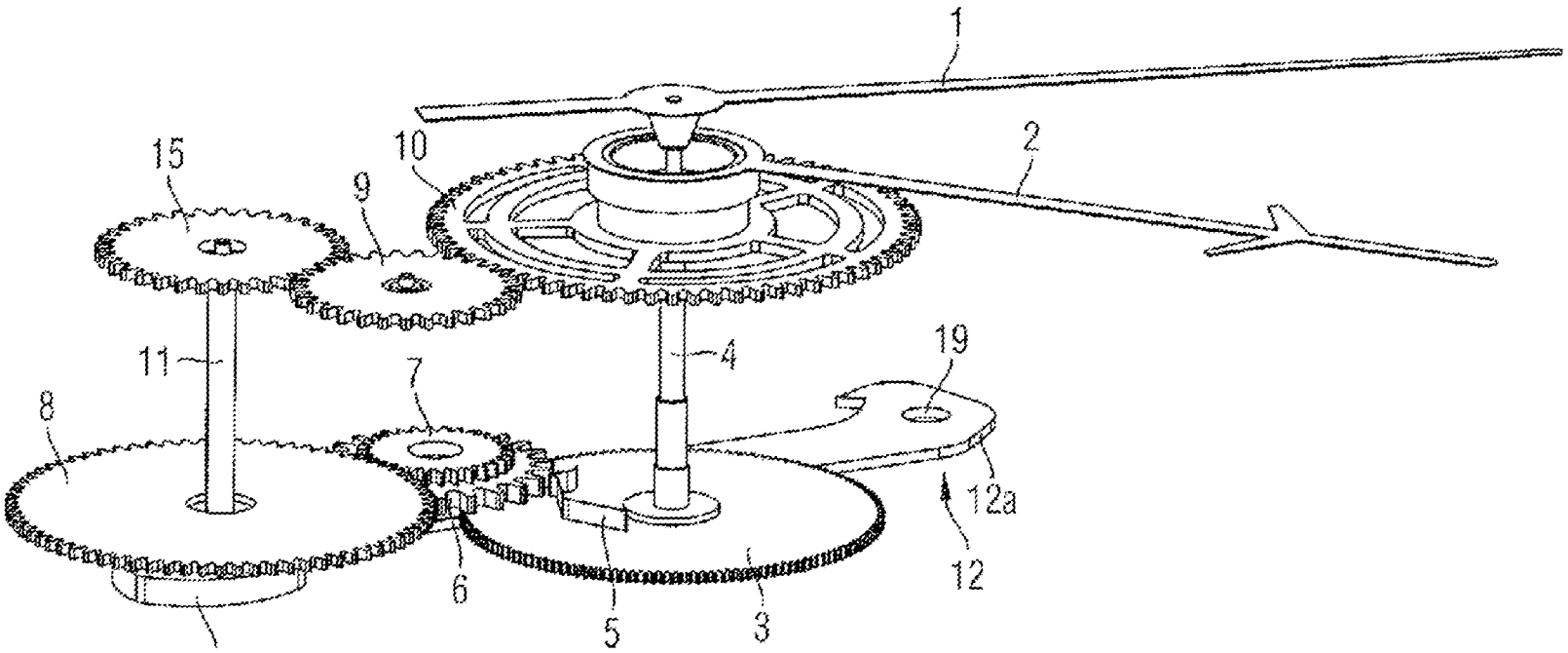
FIG. 1 is a perspective view of a chronograph according to the prior art.
Figure 2:
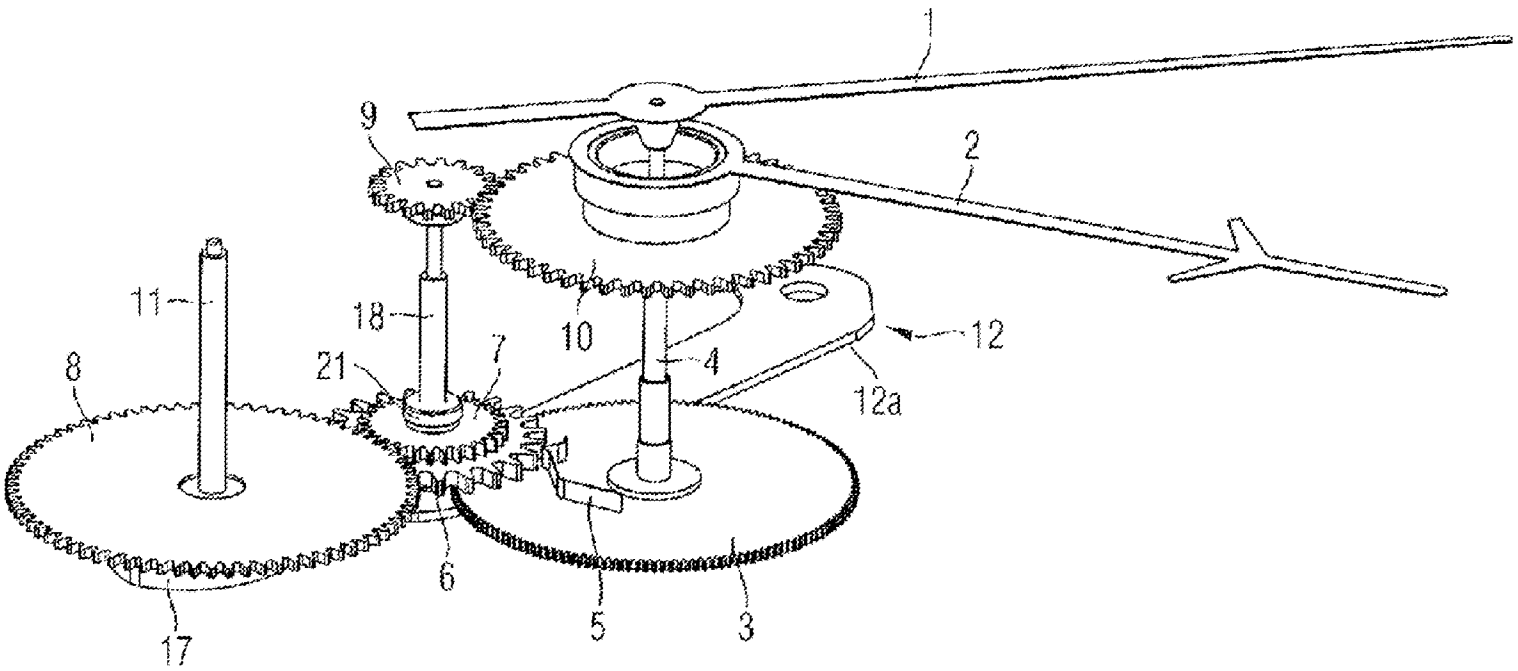
FIG. 2 is a perspective top view of a chronograph according to the present invention; and, FIG. 3 is a perspective bottom view of the chronograph shown in FIG. 2.

A chronograph, according to the invention, is schematically shown in the perspective view of FIG. 2. The drive of the chronograph is effected by a slewing drive (not shown), which forces the gear train of the clock to engage with the second wheel 3. According to the invention, the pulse-receiving wheel 6 and the drive wheel 7, which is coaxially disposed above the pulse-receiving wheel 6, are rigidly connected to a multifunction shaft 18, which is supported in the ruby bearing jewel 21 in a plate (not shown), which is disposed above the drive wheel 7. Besides, the pulse-transferring wheel 9, which is in constant engagement with the minute wheel 10, is rigidly connected to the multifunction shaft 18.

The entraining spring 5 is rigidly connected to the second wheel 3 with its section being averted to the pulse-receiving wheel 6. The section of the entraining spring 5, which is turned towards the pulse-receiving wheel 6, is constructed spring-loaded and is provided for engagement with the pulse-receiving wheel 6. The zeroing wheel 8, which is rigidly connected to the zeroing shaft 11, is in constant engagement with the drive wheel 7. The zeroing shaft 11 is supported in a plate (not shown).

After a whole rotation of the second wheel 3, the pulse-receiving wheel 6 is continued to rotate for a subunit by the entraining spring 5. The zeroing wheel 8, the pulse-transferring wheel 9 and the minute wheel 10 are continued to move by the drive wheel 7, by what the center minute hand 2 finally advances for one unit.

The center second hand 1 is rigidly connected to the second shaft 4, wherein the second shaft 4 is in contrast rigidly connected to the second wheel 3. The second shaft 4 penetrates the center of the minute wheel 10. The slewing drive (not shown) provides a direct drive of the second wheel 3, wherein the center second hand 1 is moved via the second shaft 4, as well.

Figure 3:
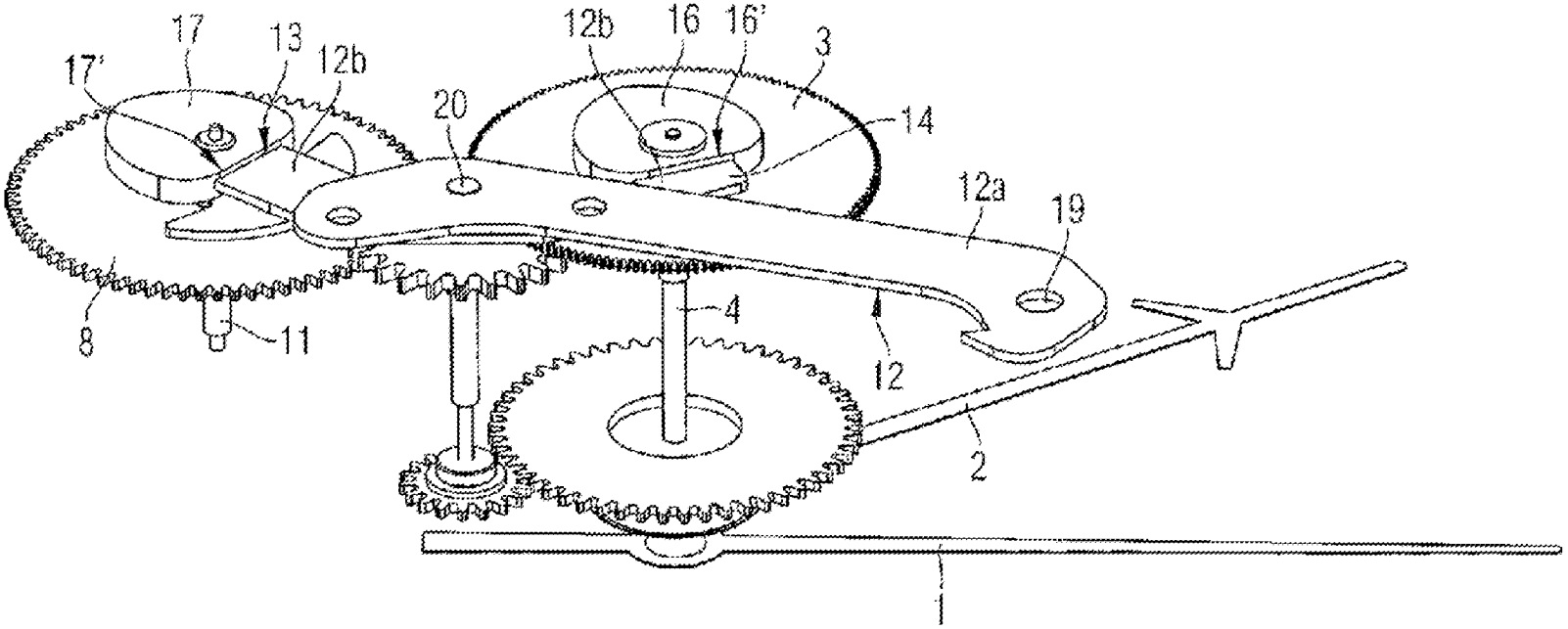

A further component of the chronograph is the two-piece constructed and rotatable stored zeroing lever 12, whose functions are to be explained with the help of FIG. 3. The zeroing lever 12 consists of a zeroing lever arm 12*a* and a zeroing lever interlock 12*b*, wherein the zeroing lever arm 12*a* is supported in a rotatable manner around the pivotal point of the zeroing lever arm 19 and the zeroing lever interlock 12*b* is connected in a rotatable manner around the pivotal point of the zeroing lever interlock 20 to the zeroing lever arm 12*a*. The zeroing interlock 12*b* is located in a plane with the zeroing heart for minutes 17 and the zeroing heart for seconds 16. The zeroing heart for minutes 17 is rigidly connected to the zeroing wheel 8 via the zeroing shaft 11, whereas the zeroing heart for seconds 16 is rigidly connected to the second wheel 3 via the second shaft 4.

For stopping the chronograph, the slewing drive (not shown) is forced to release the engagement with the second wheel 3 with the help of a pusher (not shown). Additionally, operating the pusher causes, that an appropriate holding means (not shown), as for example a blocking interlock, is forced to engage with the second wheel 3. Pressing the pusher therefore results in a halt of center second hand 5 and center minute hand 2.

For delivering the chronograph in its zero position for a further time measurement, the blocking interlock (not shown) is forced to release the engagement with the second wheel 3 with the help of a further pusher (not shown). Simultaneously, the zeroing lever arm 12*a* and therefore the zeroing lever interlock 12*b*, as well, are pivoted for a small value in their particular plane by operating the pusher, by what the zeroing lever interlock 12*b* contacts with its front the zeroing heart for minutes 17 as well as the zeroing heart for seconds 16. Therefore the zeroing heart for minutes 17 and the zeroing wheel 8, which is rigidly connected to the zeroing heart for minutes 17 via the zeroing shaft 11, as well as the zeroing heart for seconds 16 and the second wheel 3, which is rigidly connected to the zeroing heart for seconds 16 via the second shaft 4, are rotated so far, until they are in their zero position. This is the case, if the first angled end 13 of the zeroing lever interlock 12*b* touches the flattened end 17' of the zeroing heart for minutes 17 and the second angled end 14 of the zeroing lever interlock 12*b* touches the flattened end 16' of the zeroing heart for seconds 16.

Due to this movement of the zeroing wheel 8 in its zero position, the drive wheel 7, the pulse-transmitting wheel 9, the minute wheel 10 and the center minute hand 2 are moved in their particular zero position, as well. Analogous to this, the center second hand 1 is delivered to its zero position due to the movement of the second wheel 3.

Thus, it is seen that the objects of the present invention are efficiently obtained, although modifications and changes to the invention should be readily apparent to those having ordinary skill in the art, such modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention as claimed.

LIST OF REFERENCE CHARACTERS

1 Center second hand
2 Center minute hand
3 Second wheel
4 Second shaft
5 Entraining spring
6 Pulse-receiving wheel
7 Drive wheel
8 Zeroing wheel
9 Pulse-transmitting wheel
10 Minute wheel
11 Zeroing shaft
12 Zeroing lever
12*a* Zeroing lever arm
12*b* Zeroing lever interlock
13 First angled end of the zeroing lever interlock
14 Second angled end of the zeroing lever interlock
15 Intermediate wheel
16 Zeroing heart for seconds
16' Flattened end of the zeroing heart for seconds
17 Zeroing heart for minutes
17' Flattened end of the zeroing heart for minutes
18 Multifunction shaft
19 Pivotal point of the zeroing lever arm
20 Pivotal point of the zeroing lever interlock
21 Ruby bearing jewel

What is claimed is:

1. A chronograph, comprising:
a second wheel having an entraining spring;
a pulse-receiving wheel, wherein the entraining spring is configured to engage with the pulse-receiving wheel;
a drive wheel;
a zeroing wheel, wherein the zeroing wheel is in constant engagement with the drive wheel;
a pulse-transferring wheel;
a minute wheel, wherein the minute wheel is in constant engagement with the pulse-transferring wheel;
a second shaft, wherein the second wheel is rigidly connected to the second shaft; and,
a multifunction shaft orientated parallel to the second shaft, wherein the pulse-receiving wheel, the drive wheel and the pulse-transferring wheel are rigidly connected to the multifunction shaft and the pulse-transferring wheel is in constant engagement with the minute wheel.

2. The chronograph of claim 1, wherein a center second hand is rigidly connected to the second shaft and a center minute hand is rigidly connected to the minute wheel.

3. The chronograph of claim 1, wherein the drive wheel is coaxially disposed above the pulse-receiving wheel.

4. The chronograph of claim 1, further comprising a two-part constructed zeroing lever having a zeroing lever arm and a zeroing lever interlock, wherein the zeroing lever arm is supported in a rotatable manner around a pivotal point of a zeroing lever arm and the zeroing lever interlock is supported in a rotatable manner around a pivotal point of zeroing lever interlock.

5. The chronograph of claim 4, further comprising a zeroing heart for minutes rigidly connected to the zeroing wheel via a zeroing shaft.

6. The chronograph of claim 4, wherein the zeroing lever interlock has a first angled end.

7. The chronograph of claim 6, wherein the zeroing heart for minutes has a flattened end, wherein in a zero position of the chronograph, the first angled end of the zeroing lever interlock is in contact with the flattened end of the zeroing heart for minutes.

8. The chronograph of claim 4, wherein a zeroing heart for seconds is rigidly connected to a second wheel via a second shaft.

9. The chronograph of claim 4, wherein the zeroing lever interlock has a second angled end.

10. The chronograph of claim 9, wherein the zeroing heart for seconds has a flattened end, wherein in a zero position of the chronograph, the second angled end of the zeroing lever interlock is in contact with the flattened end of the zeroing heart for seconds.

* * * * *